US008816858B2

(12) United States Patent
Lim

(10) Patent No.: US 8,816,858 B2
(45) Date of Patent: Aug. 26, 2014

(54) METHOD AND DEVICE FOR PREVENTION LOSS OF ITEM AND PROMPT SEARCH THEREOF

(75) Inventor: Seong-Kyu Lim, Daegu (KR)

(73) Assignee: Seong-Kyu Lim, Daegu (KR)

( * ) Notice: Subject to any disclaimer, the term of this patent is extended or adjusted under 35 U.S.C. 154(b) by 101 days.

(21) Appl. No.: 13/810,872

(22) PCT Filed: Mar. 9, 2011

(86) PCT No.: PCT/KR2011/001644

§ 371 (c)(1),
(2), (4) Date: Jan. 17, 2013

(87) PCT Pub. No.: WO2012/011648

PCT Pub. Date: Jan. 26, 2012

(65) Prior Publication Data

US 2013/0120145 A1 May 16, 2013

(30) Foreign Application Priority Data

Jul. 23, 2010 (KR) ..... 10-2010-0071659

(51) Int. Cl.

| | |
|---|---|
| ***G08B 13/14*** | (2006.01) |
| ***G08B 1/08*** | (2006.01) |
| ***G08B 21/02*** | (2006.01) |
| ***G08B 13/24*** | (2006.01) |
| ***G08B 21/24*** | (2006.01) |

(52) U.S. Cl.

CPC ..... *G08B 13/2462* (2013.01); *G08B 21/0275* (2013.01); *G08B 21/24* (2013.01); *G08B 13/1427* (2013.01)

USPC ..... 340/572.1; 340/539.11; 340/539.32; 340/568.1; 340/539.21

(58) Field of Classification Search

USPC ..... 340/572.1, 10.1, 539.11, 539.22, 340/539.21, 539.15, 539.32, 573.4, 573.1, 340/686.6, 568.7, 568.1, 692, 539.23

See application file for complete search history.

(56) References Cited

U.S. PATENT DOCUMENTS 5,289,163 A * 2/1994 Perez et al. ..... 340/539.32
5,952,921 A * 9/1999 Donnelly ..... 340/568.6

(Continued)

FOREIGN PATENT DOCUMENTS

JP 2009-213036 9/2009
KR 20-0397625 10/2005

(Continued)

OTHER PUBLICATIONS

International Search Report mailed Nov. 1, 2011 for PCT/KR2011/001644.

*Primary Examiner* — Hoi Lau
(74) *Attorney, Agent, or Firm* — Lowe Hauptman & Ham, LLP

(57) ABSTRACT

An apparatus for preventing loss of an item and quickly searching for the item includes a slave configured to act as a radio frequency identification (RFID) tag having unique identifier information in an internal tag memory; and a hand-held master configured to function as an RFID reader and to permit the change of at least one of a recognition distance and a recognition width, at which the master recognizes the slave. When the distance between a user and an item is out of a predetermined range, a warning such as an alarm or voice signal is provided to the user, so that it is possible to prevent loss of the item. Alternatively, it is possible to quickly search for a misplaced item whenever the user desires it and has misplaced the same.

10 Claims, 8 Drawing Sheets

(56) References Cited

U.S. PATENT DOCUMENTS

| | | | | |
|---|---|---|---|---|
| 6,297,737 | B1 * | 10/2001 | Irvin | 340/571 |
| 6,331,817 | B1 * | 12/2001 | Goldberg | 340/573.1 |
| 6,515,588 | B1 * | 2/2003 | Sarabia | 340/568.1 |
| 6,956,475 | B1 * | 10/2005 | Hill | 340/539.11 |
| 6,956,480 | B2 * | 10/2005 | Jespersen | 340/568.1 |
| 7,034,684 | B2 * | 4/2006 | Boman et al. | 340/568.1 |
| 7,106,191 | B1 * | 9/2006 | Liberati | 340/539.15 |
| 7,148,801 | B2 * | 12/2006 | Crabtree et al. | 340/539.13 |
| 7,271,715 | B2 * | 9/2007 | Aupperle et al. | 340/539.13 |
| 7,274,292 | B2 * | 9/2007 | Velhal et al. | 340/539.32 |
| 7,696,887 | B1 * | 4/2010 | Echavarria | 340/573.1 |
| 7,898,414 | B2 * | 3/2011 | Spano | 340/571 |
| 2002/0113705 | A1 * | 8/2002 | Wallace | 340/568.7 |
| 2003/0063003 | A1 * | 4/2003 | Bero et al. | 340/573.1 |
| 2004/0130448 | A1 * | 7/2004 | McDonald et al. | 340/572.1 |
| 2004/0217859 | A1 * | 11/2004 | Pucci et al. | 340/539.32 |
| 2005/0088302 | A1 * | 4/2005 | Pucci et al. | 340/568.1 |
| 2005/0134459 | A1 * | 6/2005 | Glick et al. | 340/572.1 |
| 2005/0148339 | A1 * | 7/2005 | Boman et al. | 455/456.1 |
| 2005/0285739 | A1 * | 12/2005 | Velhal et al. | 340/572.1 |
| 2007/0046439 | A1 * | 3/2007 | Takaku et al. | 340/10.41 |
| 2008/0030325 | A1 * | 2/2008 | Fries | 340/539.32 |
| 2008/0106399 | A1 * | 5/2008 | Yaqub et al. | 340/539.11 |
| 2008/0252425 | A1 * | 10/2008 | Okegawa et al. | 340/10.1 |
| 2009/0021350 | A1 * | 1/2009 | Hatta et al. | 340/10.1 |
| 2009/0045958 | A1 * | 2/2009 | Spano | 340/572.2 |
| 2009/0146804 | A1 * | 6/2009 | August et al. | 340/539.13 |
| 2009/0167502 | A1 * | 7/2009 | Erickson et al. | 340/10.3 |
| 2010/0045439 | A1 * | 2/2010 | Tak et al. | 340/10.1 |
| 2010/0295665 | A1 * | 11/2010 | Landau et al. | 340/10.42 |
| 2013/0120145 | A1 * | 5/2013 | Lim | 340/572.1 |

FOREIGN PATENT DOCUMENTS

| | | |
|---|---|---|
| KR | 10-2006-0111232 | 10/2006 |
| KR | 10-2007-0035688 | 4/2007 |
| KR | 10-2007-0055473 | 5/2007 |
| KR | 10-2010-0045285 | 5/2010 |

* cited by examiner

METHOD AND DEVICE FOR PREVENTION LOSS OF ITEM AND PROMPT SEARCH THEREOF

CROSS-REFERENCE TO RELATED APPLICATION

This application claims the priority of Korean Patent Application No. 10-2010-0071659, filed on Jul. 23, 2010 in the KIPO (Korea Intellectual Property Office). Further, this application is the National Phase application of International Application No. PCT/KR2011/001644 filed on Mar. 9, 2011, which designates the United States and was published in Korean.

BACKGROUND

The disclosure relates to an apparatus for preventing the loss of an item, and more particularly, to an apparatus and method for preventing the loss of a user's item by issuing an alarm when the item is out of a predetermined range of the user and/or permitting a quick search for the item which the user has misplaced.

Nowadays, many people carry bags such as handbags or briefcases or carry things such as cellular phones, purses or books while they are out. There frequently occurs a situation where a person unintentionally puts his/her belonging down while conducting business in a bank or other personal business, a situation where a person gets off a subway or out of a taxi and has left his/her item in the subway or taxi, or a situation where a person loses his/her important item or items while being absorbed doing something.

Everyone has had the experience of wandering from place to place before leaving his/her house so as to search for a desired item because he/she cannot find his/her cellular phone, bag, purse, glasses or the like.

Therefore, there is seen a need for an apparatus capable of issuing an alarm to a user when he/she loses his/her item or items and/or needs to quickly search for a misplaced item.

SUMMARY

One of disclosed embodiments is directed to an apparatus and method for preventing loss of a user's item by issuing an alarm when the item is out of a predetermined range of the user and/or enabling a quick search for an item which the user has misplaced.

In accordance with an embodiment, an apparatus for preventing loss of an item and/or enabling a quick search for the item, includes a slave configured to perform a function of a radio frequency identification (RFID) tag having unique identifier information in an internal tag memory; and a handheld master configured to perform a function of an RFID reader and change a recognition distance (range) at which the master recognizes the slave. The master includes a user interface unit configured to have an input unit and an output unit; an antenna configured to communicate, by radio, with the slave; a transmission/reception unit connected to the antenna so as to transmit/receive, by radio, data to/from the slave; an alarm and voice output unit configured to output an alarm or voice; an output power adjustment unit configured to adjust an output power of the transmission unit in the transmission/reception unit under a predetermined control; and a control unit configured to register a slave to be registered as a tag for preventing loss of an item and quickly searching for the item in a memory through the user interface unit, when there is a request for setting a range of a recognition area having the recognition distance of the registered slave through the user interface unit, set the requested range of the recognition area in the memory, when an outgoing mode is operated through the user interface unit, continuously perform, by radio, recognition communication between the master and the registered slave in the range of the recognition area through the output power adjustment unit, when the distance between the master and the registered slave is out of the range of the recognition area, provide an alarm and voice through the alarm and voice output unit of the master, and when a searching mode is operated through the user interface unit, output a detection volume generated by the level of a recognized electric field intensity of the registered slave and provide a voice through the alarm and voice output unit by trying recognition communication between the master and the registered slave in the set range of the recognition area.

In accordance with another embodiment, an apparatus for preventing loss of an item and/or enabling a quick search for the item, includes a slave configured to perform a function of a radio frequency identification (RFID) tag having unique identifier information in an internal tag memory; and a handheld master configured to perform a function of an RFID reader and change at least one of a recognition distance and a recognition width (scope), at which the master recognizes the slave. The master includes a user interface unit configured to have an input unit and an output unit; a plurality of antennas configured to communicate, by radio, with the slave; a transmission/reception unit configured to transmit/receive, by radio, data to/from the slave; a signal distribution and synthesis unit configured to selectively connect a signal between the transmission/reception unit and the plurality of antennas under a predetermined control; an alarm and voice output unit configured to output an alarm or voice; an output power adjustment unit configured to adjust an output power of the transmission unit in the transmission/reception unit under a predetermined control; and a control unit configured to register a slave to be registered as a tag for preventing loss of an item and quickly searching for the item in a memory through the user interface unit, when there is a request for setting a range of a recognition area having at least one of the recognition distance and recognition width of the registered slave through the user interface unit, set the requested range of the recognition area in the memory, when an outgoing mode is operated through the user interface unit, continuously perform, by radio, recognition communication between the master and the registered slave in the range of the recognition area through the selective use of the antennas and the output power adjustment unit, when the distance between the master and the slave to be registered is out of the range of the recognition area, provide an alarm and voice through the alarm and voice output unit of the master, and when a searching mode is operated through the user interface unit, output a detection volume generated by the level of a recognized electric field intensity of the registered slave and provide a voice through the alarm and voice output unit by trying recognition communication between the master and the registered slave in the set range of the recognition area.

The master may further include a voice recognition and synthesis unit configured to perform voice recognition and voice synthesis. The slave may be configured to as a rewritable tag in which data is recorded on and erased from the memory.

The slave may include tags formed in the shapes of a coin, a band, a stick, a card and a mobile phone strap in which an antenna is woven with a conductive fiber.

In accordance with another embodiment, a method for preventing loss of an item and/or for quickly searching for the item using an apparatus comprising a slave configured to perform a function of a radio frequency identification (RFID) tag having unique identifier information in an internal tag memory and a hand-held master configured to perform a function of an RFID reader and change at least one of a recognition distance and a recognition width, at which the master recognizes the slave, the method includes registering a slave to be registered as a tag for preventing loss of an item and quickly searching for the item by performing a registration mode through a user interface in the master; when there is a request for setting a range of a recognition area having at least one of the recognition distance and the recognition width of the registered slave through the user interface of the master, setting the requested range of the recognition area in a memory; when an outgoing mode is operated through the user interface of the master, setting a range of a recognition area through the selective use of a plurality of antennas and the adjustment of the transmission output power of the master and continuously performing, by radio, recognition communication between the master and the registered slave in the range of the recognition area; when the distance between the master and the registered slave is out of the range of the recognition area while continuously performing the recognition communication between the master and the registered slave in the operation of the outgoing mode, providing an alarm and voice through the master; when a searching mode is operated through the user interface of the master, trying the recognition communication between the master and the registered slave in the set range of the recognition area; and outputting a detection volume generated by the level of a recognized electric field intensity of the registered slave and providing a voice through the master by trying the recognition communication between the master and the registered slave in the operation of the searching mode.

The method may further include, when item information is inputted to the master through an input interface having at least one of a voice recognition input and a touch screen input in the registration mode, recording, by radio, the item information in a tag memory of a slave to be registered.

DESCRIPTION OF SPECIFIC EMBODIMENTS

Figure 1:
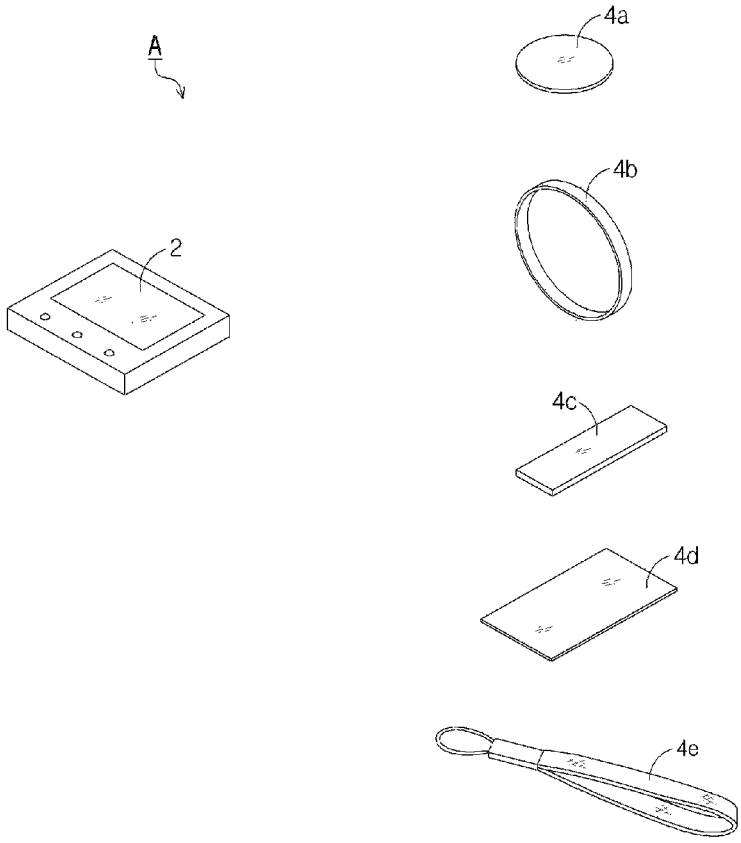
FIG. 1 is a fragmented or dissembled view of an apparatus for preventing loss of an item and enabling a quick search for the item in accordance with an embodiment.

Exemplary embodiments of the disclosure will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments.

FIG. 1 is a configuration view of an apparatus for preventing loss of an item and/or enabling a quick search for the item in accordance with an embodiment of the disclosure, which illustrates a configuration employing a radio frequency identification (RFID) scheme.

The apparatus A includes a master 2 corresponding to an RFID reader in an RFID system and a plurality of slaves 4*a* to 4*e* corresponding to tags in the RFID system.

Generally, the RFID system includes a tag having unique identifier information stored in an internal tag memory, a reader for reading the identifier information of the tag or recording new information, and a computer connected to the reader. Here, the tag is referred to as a transponder, and the reader is referred to as an interrogator.

In the embodiment, the tag corresponding to each of the slaves 4*a* to 4*e* is composed of an antenna and an RFID IC chip, and may be manufactured in various types or shapes. For example, the tag may be attached to an item, person, animal, etc., may be woven in clothes, may be carried by a person, or the like. That is, as shown in examples of FIG. 1, the slaves 4*a* to 4*e* may be variously manufactured in the shapes of a coin, a band, a stick, a card, a mobile phone strap in which an antenna is woven with a conductive fiber, and the like. Korean Patent No. 10-0764031 entitled "Coin type RFID tag" has been disclosed as an example of the coin type tag designated by reference numeral "4*a*". Korean Patent Publication No. 10-2010-0073686 entitled "Methods of attaching RFID chip to fiber tag with an electric-thread" has been disclosed as an example related to the tag using a conductive fiber, such as the mobile-phone-strap type tag designated by reference numeral "4*e*". The slave 4*a* that is a coin type tag may have a size (mm/inch) of 1×1, 2×2, or the like, and may be provided as a label attachment type tag or a token type tag.

In the tags that constitute the slaves 4*a* to 4*e*, the RFID IC chip (microchip) is positioned at a feeding point of the tag antenna. The tag receives all required energy from a signal of the reader. The tag retransmits a coded signal containing information of the tag to the reader in a UHF frequency through electromagnetic backscattering using the tag antenna. That is, the tag antenna retransmits, to the reader, a part of the energy received from the reader. Electric power is applied to the tag by converting microwave energy into DC voltage using a schottky rectifier circuit. While a passive tag operates using the rectified DC voltage, an active tag has a power source.

In the embodiment, a tag memory in the RFID IC chip (microchip) of each of the slaves 4*a* to 4*e* is a memory in which new information can be recorded, and most preferably a re-writable memory in which the recording and erasing of new information are all possible. That is, RFID tags having a re-writable function are most preferably used as the slaves 4*a* to 4*e*. In the slaves 4*a* to 4*e* having the re-writable function, the tag memory in the microchip is a re-writable memory.

The RFID reader corresponding to the master 2 transmits an electromagnetic field to the tag through an antenna for the reader, and transmits/receives data to/from the tag while supplying power to the tag.

In accordance with the embodiment, the master 2 that is the RFID reader is a hand-held RFID reader. Particularly, the size of the master 2 may be small, e.g., up to almost half of the size of a name card, so that a person can simply carry the master 2. The thickness of the master 2 may be as thin as 5 to 10 mm.

Figure 3A:
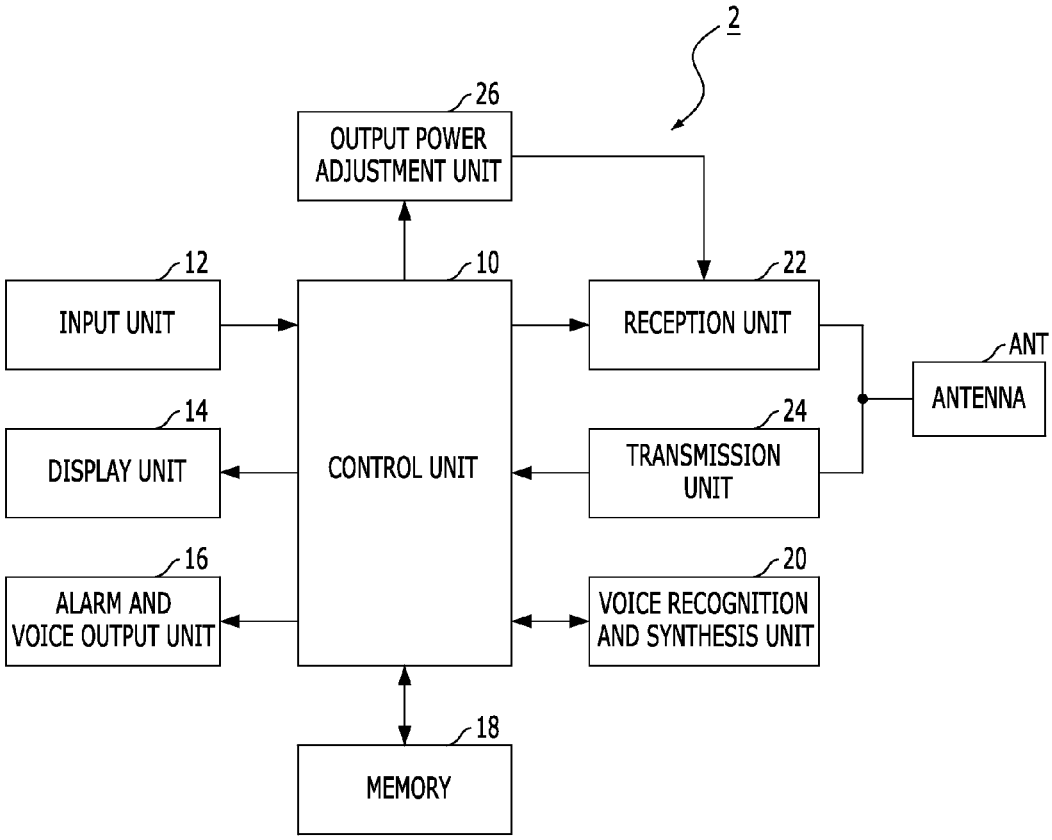
FIGS. 3A and 3B are block diagrams illustrating circuits of the masters shown in FIGS. 2A and 2B, respectively.
Figure 3B:
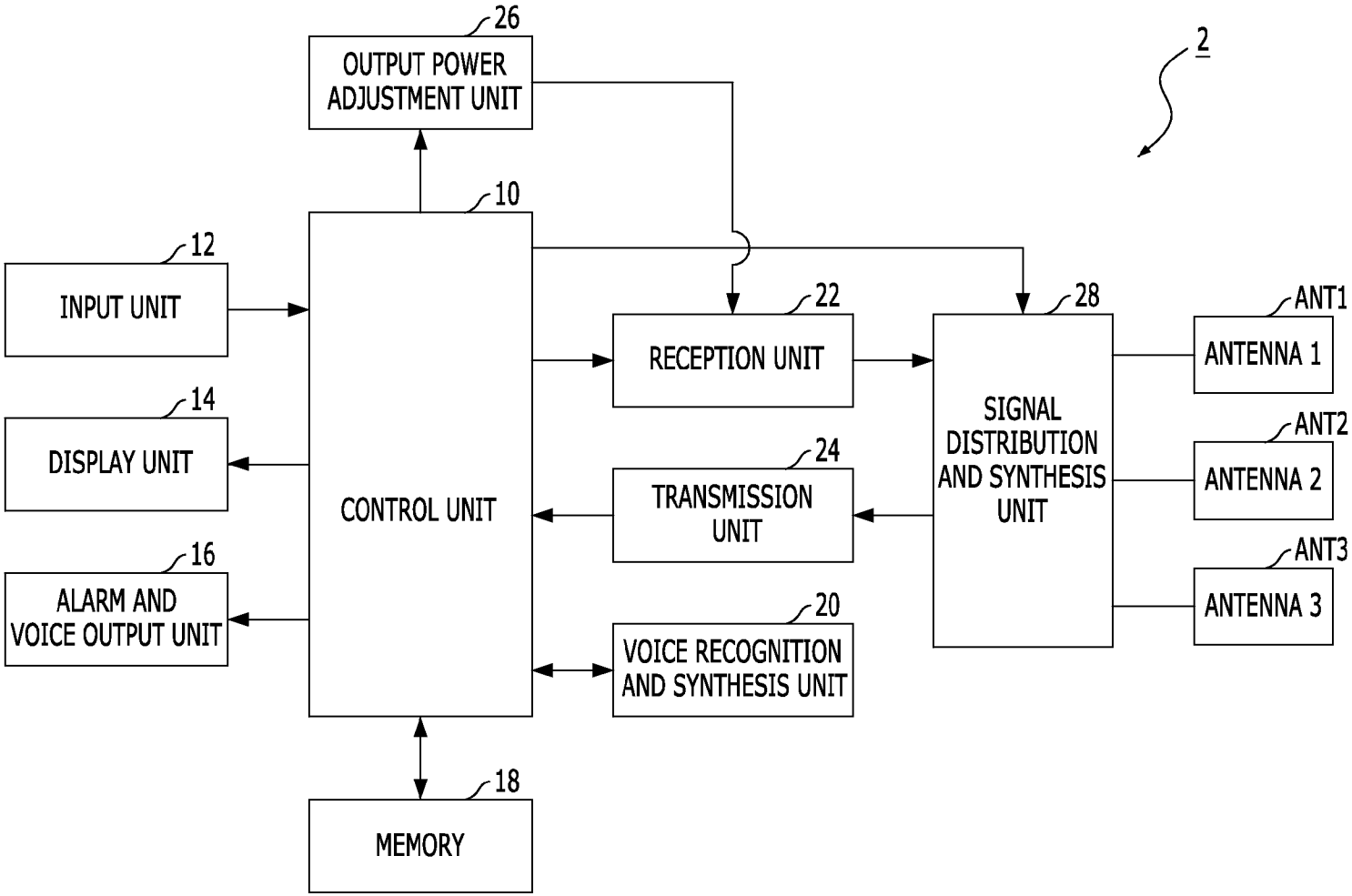

The master 2 in accordance with the embodiment has a configuration capable of changing the recognition distance and recognition width at which the master 2 can recognize each of the slaves 4*a* to 4*e* so as to easily prevent loss of an item and quickly searching for the item. The change in recognition distance capable of recognizing the slave can be accomplished by controlling the output power of the master 2 based on a user's demand through a user interface unit composed of input and output units, i.e., through an input unit 12, a display unit 14, a voice recognition and synthesis unit 20, an alarm and voice output unit 16 and the like, as shown in FIGS. 3A and 3B, or based on a self-control through a mapping program. The change in recognition width can be accomplished by installing one or more antennas in the master 2 and controlling the antennas through a self-mapping program.

In the embodiment, the apparatus is implemented suitable for preventing loss of an item and quickly searching for the item by using the fact that the effective recognition distance of the RFID system does not exceed about 6 m or more. That is, if the distance between the master 2 and the slaves 4*a* to 4*e* is out of a predetermined recognition range in the state that the communication between the master 2 and the slaves 4*a* to 4*e* is continuously performed, an alarm or urgent voice information is provided through the master 2.

Particularly, in the embodiment, the apparatus is operated suitable for a corresponding mode by changing the recognition distance and recognition width depending on a user's demand or mode (outgoing or searching mode). The 'outgoing mode' is a mode that may be set to prevent loss of an item, and the 'searching mode' is a mode that may be set to quickly search for the item. Operations in the outgoing and searching modes will be described in detail later with reference to FIGS. 6 and 7, respectively.

Figure 2A:
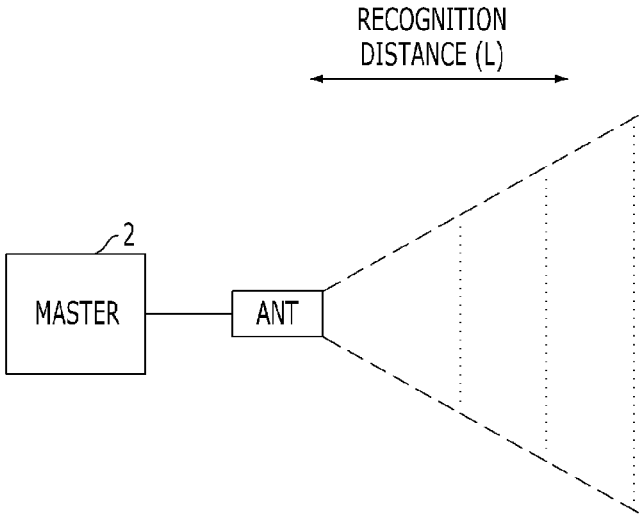
FIGS. 2A and 2B are views illustrating a recognition distance and a recognition width in a master (unit) shown in FIG. 1.
Figure 2B:
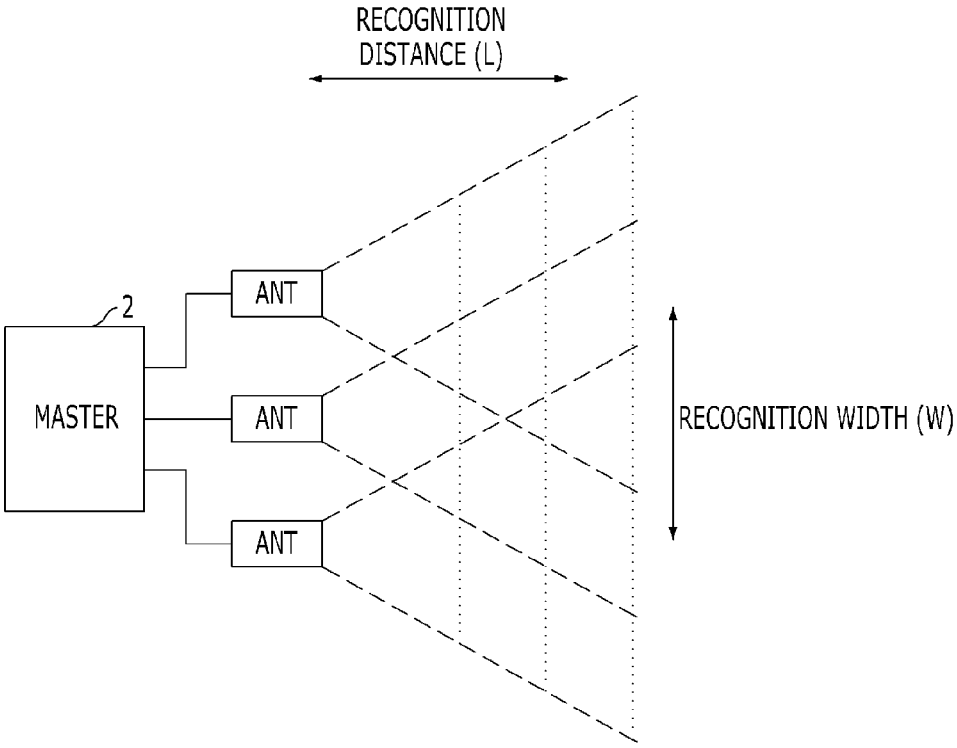

FIG. 2A illustrates recognition distance L changed by controlling the output power of the master 2 in the state that one antenna ANT is installed and operated in the master 2. FIG. 2B illustrates recognition width W and recognition distance L changed by controlling the output power of the master 2 in the state that a plurality of antennas, e.g., three antennas are installed and operated in the master 2.

In order to implement the apparatus for preventing loss of an item and quickly searching for the item in accordance with the embodiment, the master that is an RFID reader, as shown in FIGS. 3A and 3B, has a user interface unit including an input unit 12 such as a button or touch screen, a display unit 14 such as an LCD, a voice recognition and synthesis unit 20, an alarm and voice output unit 16, and the like. The input unit 12 such as the touch screen and a voice recognition unit of the voice recognition and synthesis unit 20 correspond to an input unit of the user interface unit. The display unit 14 such as the LCD, a voice synthesis unit of the voice recognition and synthesis unit 20 and the alarm and voice output unit 16 correspond to an output unit of the user interface unit.

In order to change the output power of a transmission unit 22 in transmission and reception units 22 and 24 connected to the antenna ANT, the master 2 has an output power adjustment unit 26 that adjusts the output power of the transmission unit 22 under the control of a control unit 10. The master 2 also has the control unit and a memory 18 so as to perform the whole control of the master 2. A hot key, e.g., a power key, a key corresponding to the outgoing mode, a key corresponding to the searching mode, etc., which may be frequently used for convenience of a user's input in the input unit 12, is preferably implemented in the form of a button or switch. Other various function keys are preferably implemented as function keys using the touch screen.

Particularly, in FIG. 3B, the master 2 has a configuration in which a plurality of antennas, e.g., three antennas ANT1, ANT2 and ANT 3 are installed in the master 2. In order to install the three antennas ANT1, ANT2 and ANT3 in the master 2, a signal distribution and synthesis unit that selectively distributes and synthesizes a radio signal under the control of the control unit 10 are further provided between the transmission and reception units 22 and 24 and the three antennas ANT1, ANT2 and ANT3.

Specific operations configured suitable for preventing loss of an item and quickly searching for the item in accordance with the embodiment will be described in detail with reference to FIGS. 4 to 7.

Figure 4:
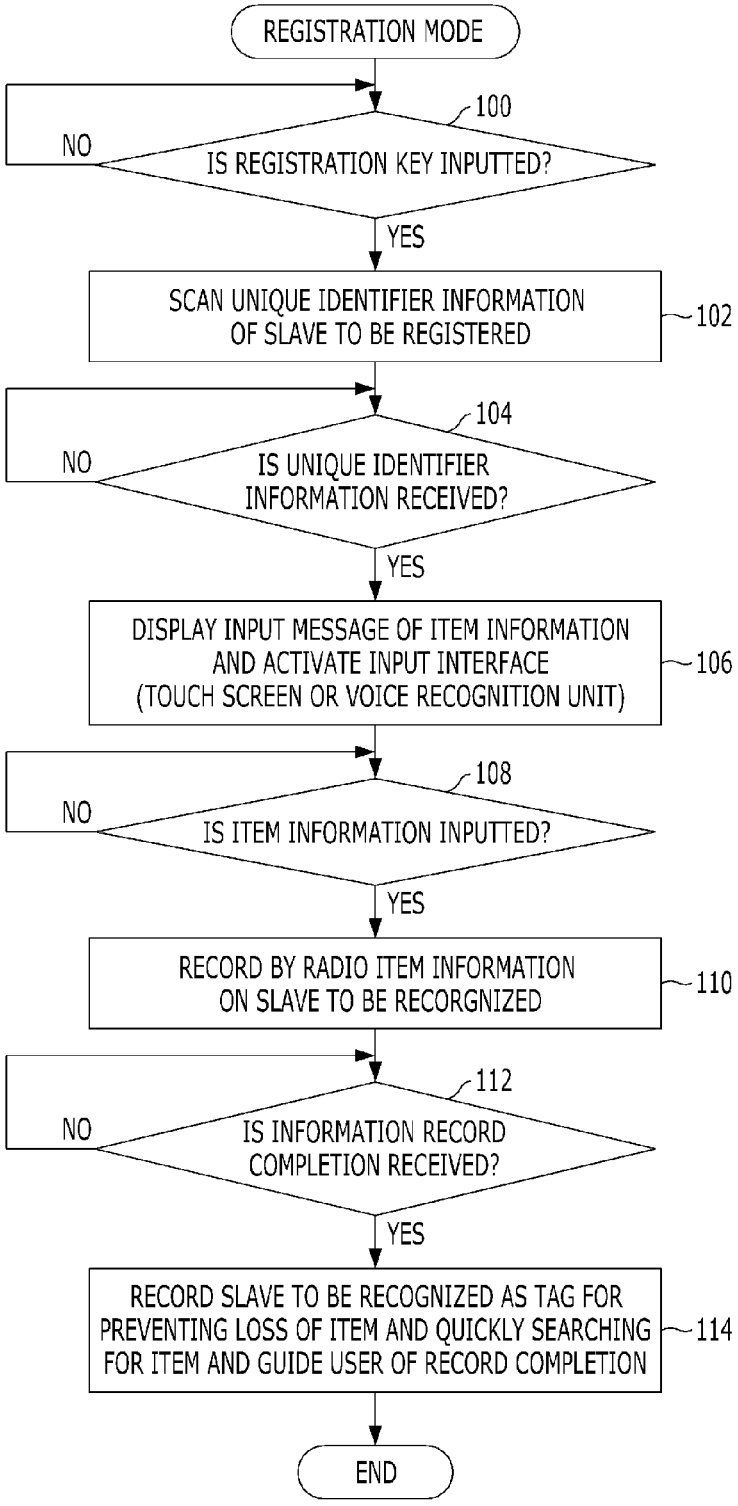
FIG. 4 is a control flowchart illustrating a registration mode routine according to an embodiment.
Figure 5:
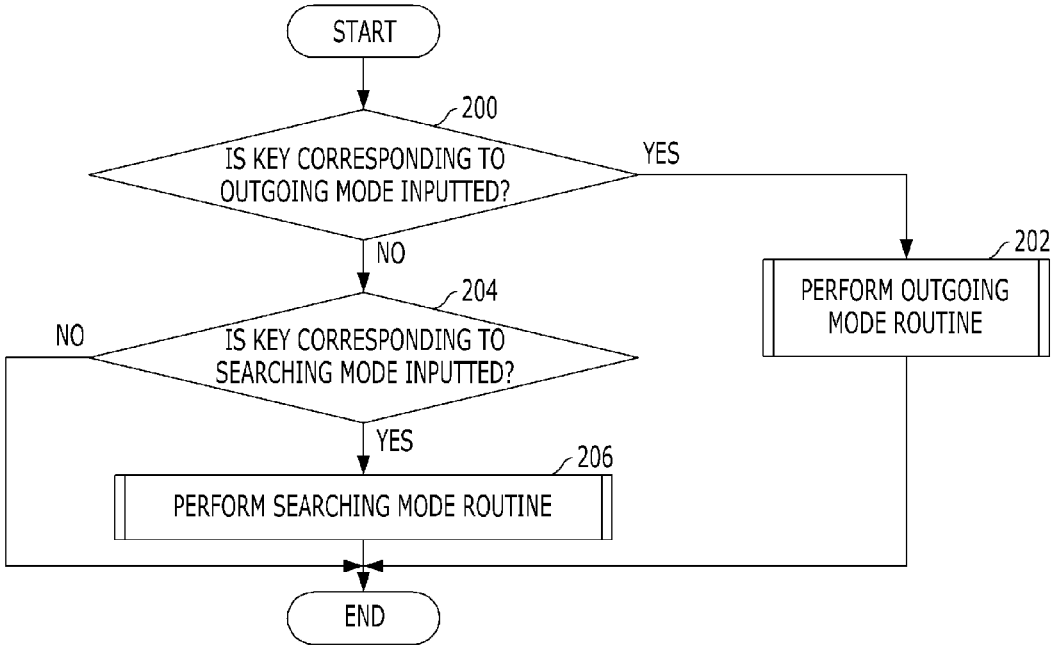
FIG. 5 is a total control flowchart illustrating a method for preventing loss of an item and for enabling a quick search for the item according to an embodiment.
Figure 6:
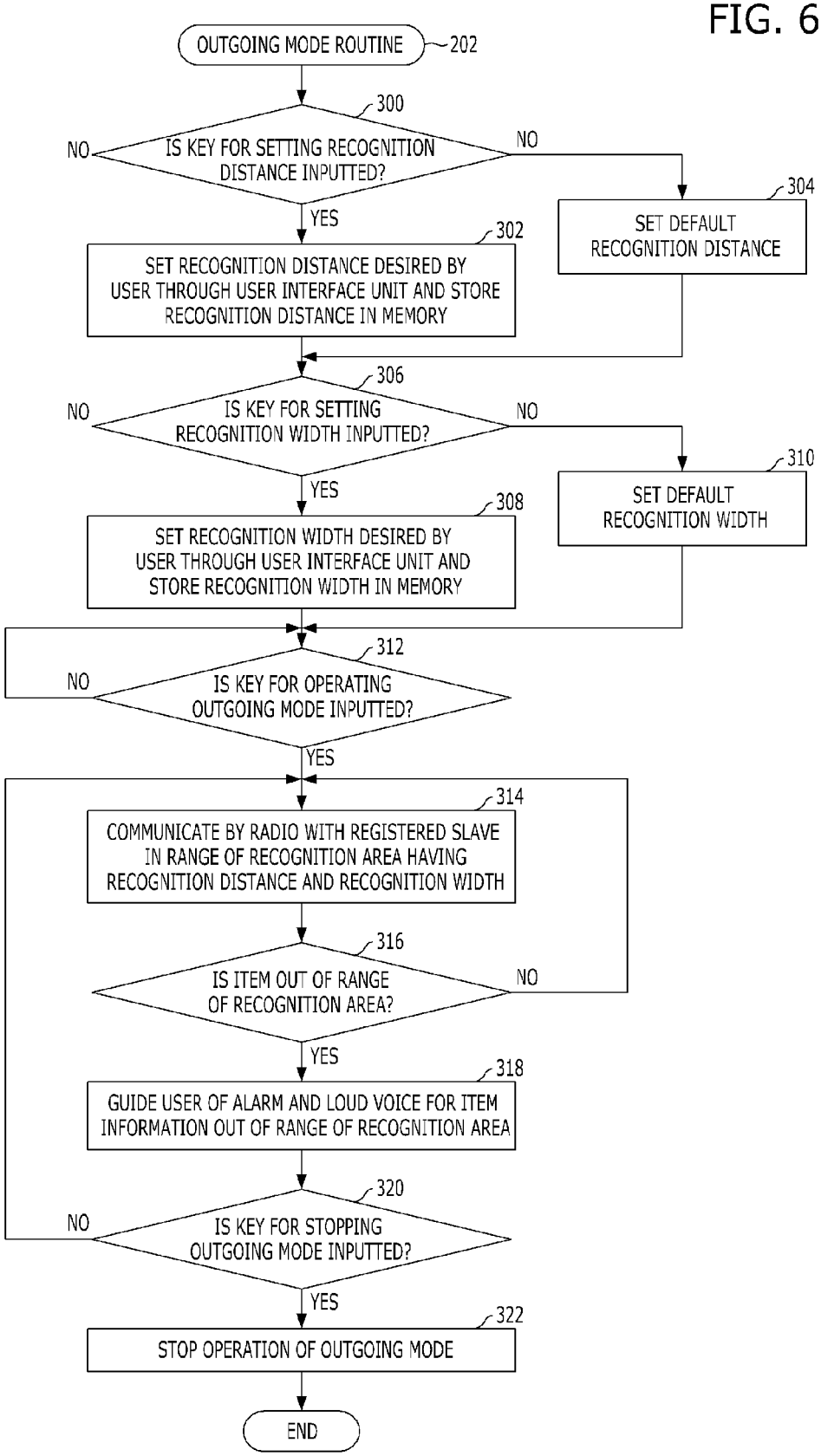
FIG. 6 is a control flowchart illustrating an outgoing mode routine in FIG. 5.
Figure 7:
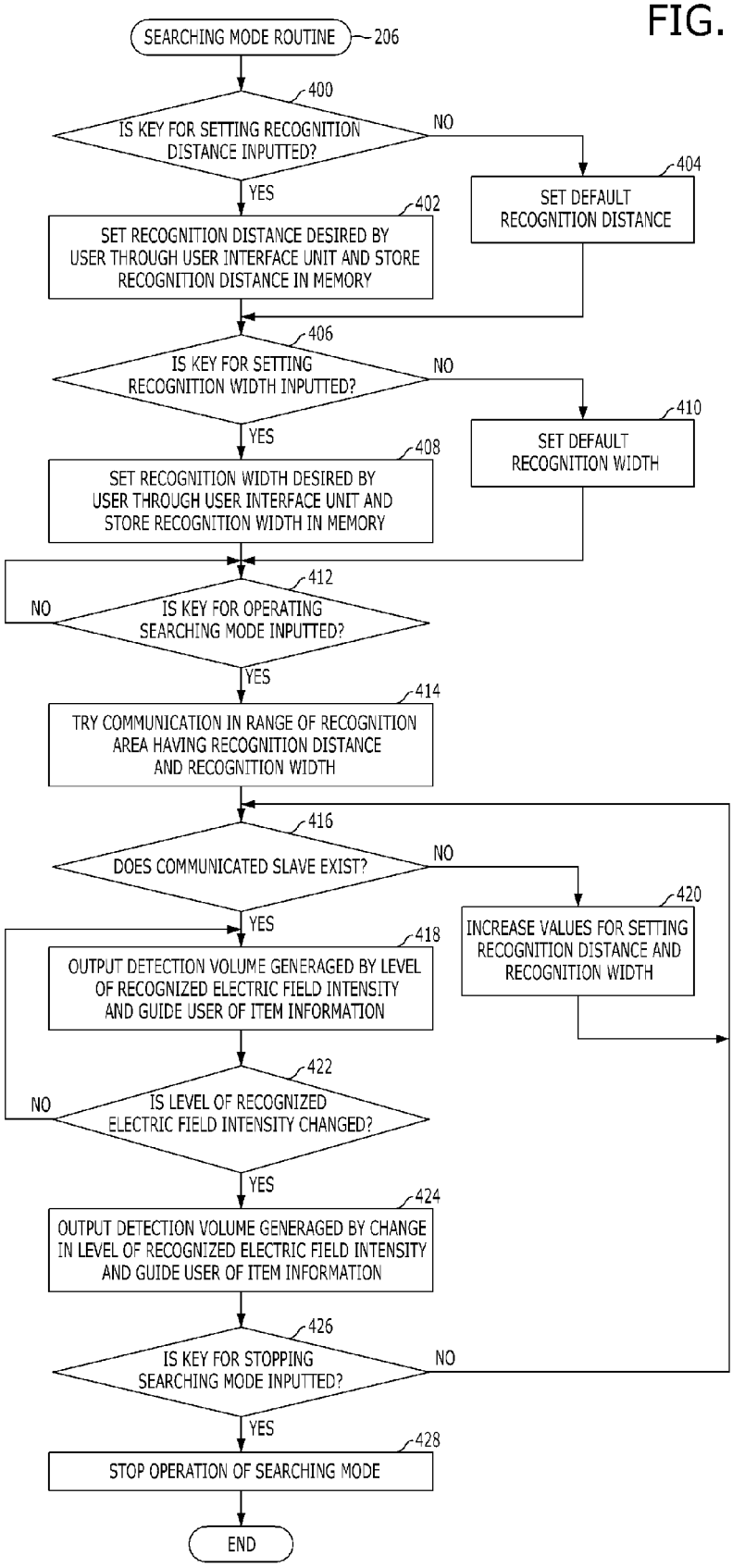
FIG. 7 is a control flowchart illustrating a searching mode routine in FIG. 5.

FIG. 4 is a control flowchart illustrating a registration mode routine according to an embodiment. FIG. 5 is a total control flowchart illustrating a method for preventing loss of an item and quickly searching for the item according to an embodiment. FIG. 6 is a control flowchart illustrating an outgoing mode routine in FIG. 5. FIG. 7 is a control flowchart illustrating a searching mode routine in FIG. 5.

First, a procedure for registering the slaves 4*a* to 4*e* to be respectively matched to user's items will be described in detail with reference to the control flowchart of FIG. 4.

If a user puts one slave having a his/her desired tag shape among the various kinds of slaves 4*a* to 4*e* in front of himself/herself and then presses a registration key among keys provided to the input unit 12 of the master 2, the control unit 10 of the master 2 recognizes the registration key at step 100 of FIG. 4 and then proceeds to step 102 of FIG. 7 so as to scan the unique identifier information of the slave 4*k* (k=a, b, . . . , e) to be registered. That is, if the control unit 10 of the master transmits by radio a scan request through the transmission unit 22, a microchip in the slave 4*k* to be registered reads a unique identifier information mapped to an internal tag memory in response to the scan request received through a tag antenna and then transmits the unique identifier information to the master 2.

Accordingly, the control unit 10 of the master 2 determines whether or not the unique identifier information is received from the slave 4*k* to be registered, scanned at step 104 of FIG. 4. If it is determined that the unique identifier information is received, the control unit 10 proceeds to step 106 of FIG. 4 so as to display a message instructing the user to input item information in the display unit or the like and to allow the user to input the item information by activating the input unit 12 such as the touch screen or the voice recognition unit of the voice recognition and synthesis unit 20. For example, the user may input item information 'bag' using characters or voice.

If the user inputs the item information, the control unit 10 of the master 2 recognizes the item information at step 108 of FIG. 4 and then proceeds to step 110 of FIG. 4 so as to control the inputted item information as new information to be recorded by radio in the slave 4*k* to be registered. The distance at which the information is recorded by radio from the master 2 to the slave 4*k* to be registered hardly exceeds 1*m* or more, unlike the recognition distance at which the information of the slave 4*k* can be read by radio. Thus, the information is preferably recorded in a place close to the slave 4*k*.

Then, if the control unit 10 receives a message informing that the recording of the item information is completed from the slave 4*k* to be registered (step 112 of FIG. 4), the control unit 10 proceeds to step 114 of FIG. 4 so as to register the corresponding slave 4*k* as a tag for preventing loss of the item and quickly searching for the item in the internal memory 18 and to provide a message informing that the recording of the item information has been completed through the display unit 14 or the alarm and voice output unit 16.

In such a manner, desired information can be recorded in slaves respectively corresponding to items necessary for preventing loss of items and instigating a quick search for the items. For example, information is recorded in slaves respectively corresponding to a handbag, a cellular phone, a purse, and the like. In this case, information 'handbag' may be recorded in the slave 4*c* such as the stick-type tag to be put into the handbag, and information 'cellular phone' may be recorded in the slave 4*e* such as the mobile-phone-strap type tab to be hung to the cellular phone. Also, information 'purse' may be recorded in the slave 4*d* such as the card-type tag to be put into the purse.

By doing so, the slaves 4*k* to be registered become registered slaves 4*k*.

Next, an operation performed by a user to prevent loss of an item or quickly induce a search for the item will be described with reference to FIG. 5. In FIG. 5, an outgoing mode and a searching mode exist in the operation. Here, the outgoing mode is properly performed when the user goes out, and the searching mode is significantly used when the user comes back into the house and searches for the item.

If the user inputs a key corresponding to the outgoing mode using the input unit 12 of the master 2, the control unit 10 recognizes the inputted key at step 200 of FIG. 5 and then proceeds to step 202 of FIG. 5 so as to perform an outgoing mode routine. The control operation of the outgoing mode routine will be described in detail with reference to FIG. 6.

If the user inputs a key corresponding to the searching mode using the input unit 12 of the master 2, the control unit 10 recognizes the inputted key at step 204 of FIG. 5 and then proceeds to step 206 of FIG. 5 so as to perform a searching mode routine. The control operation of the searching mode routine will be described in detail with reference to FIG. 7.

The outgoing mode routine will now be described in detail with reference to FIG. 6.

After the control unit 10 of the master 2 enters into the outgoing mode based on the inputted key corresponding to the outgoing mode, the user may set a desired recognition distance and recognition width using keys for setting the recognition distance and recognition width, provided to the input unit 12. If the user does not set the recognition distance and recognition width, a recognition operation for the registered slave 4*k* is performed using preset default values of the recognition distance and recognition width. The values of the recognition distance and recognition width, set by the user, become the range of a recognition area.

If the user inputs a key for setting the recognition distance, the control unit 10 recognizes the inputted key at step 300 of FIG. 6 and then proceeds to step 302 of FIG. 6 so as to set a recognition distance desired by the user through the user interface unit and to store the recognition distance in the memory 18. If it is determined at the step 300 of FIG. 6 that the user does not input the key for setting the recognition distance, the control unit proceeds to step 304 of FIG. 6 so as to set the recognition distance as a default value of the recognition distance.

If the user inputs a key for setting the recognition width, the control unit 10 recognizes the inputted key at step 306 of FIG. 6 and then proceeds to step 308 of FIG. 6 so as to set a recognition width desired by the user through the user interface unit and to store the recognition width in the memory 18. If the user does not input the key for setting the recognition width at the step 306 of FIG. 6, the control unit 10 sets the recognition width as a default value of the recognition width.

In the setting of the recognition width, if only one antenna ANT is installed in the master as shown in FIG. 2A or 3A, the default value of the recognition width is set, and a separate key for setting the recognition width is not provided.

If the user goes out into a public place which is slightly dangerous and noisy, the distance between the user and the item is necessarily close, and accordingly, it is sufficient to set a recognition area suitable for the public place. If the user goes out to a place which is silent and still with small risk of loss, it is possible that the distance between the user and the item is relatively distant. If the user carries the registered slave 4*k* with very small volume while putting the master 2 into the bag, the recognition width is preferably set wide so that the master 2 can suitably recognize the moving registered slave 4*k* of the user. If the recognition width is set wide, several antennas ANT1, ANT 2 and ANT 3 are simultaneously operated as shown in FIG. 2B or 3B.

If the user inputs a key for operating the outgoing mode after the recognition area having the user's desired recognition distance and recognition width is set as described above, the control unit 10 recognizes the inputted key at step 312 of FIG. 6. Then, the control unit 10 proceeds to step 314 of FIG. 6 so as to communicate with the registered slave 4*k* in the range of the recognition area having the recognition distance and recognition width. If the communication between the control unit 10 and the registered slave 4*k* is performed, the master 2 recognizes the item information of the registered slave 4*k*. Generally, the master 2 that is an RFID reader can recognize a few tens of tags or more, i.e., slaves.

If the user is out of the recognition area by moving in the state that the user puts the item having the registered slave 4*k* in a place, the control unit 10 of the master 2 recognizes that the item is out of the recognition area at step 316 of FIG. 6 and then proceeds to step 318 of FIG. 6.

At the step 318 of FIG. 6, the control unit 10 of the master 2 outputs, to the user, an alarm and loud voice for the item information out of the recognition area using the alarm and voice output unit 16. For example, if the item information is a bag, the control unit 10 of the master 10 enables the user to hear an urgent, loud voice "bag, bag". Since the master 2 has previously obtained the item information 'bag' from the registered slave 4*k*, the master can recognize the information of the item. Since the output of voice can by performed by synthesizing the voice through the voice synthesis unit of the voice recognition and synthesis unit 20 and then amplifying the synthesized voice.

If the user receives the alarm and the loud voice, the user quickly recognizes that the user putted the item in the place just before the user moves a few meters. Thus, the user can return to the place and find the item. Accordingly, it is possible to prevent the loss of the item in advance.

If the user does not require the operation of the outgoing mode any more and inputs a key for stopping the outgoing mode, the control unit 10 recognizes the inputted key at step 320 of FIG. 6 and then proceeds to step 322 of FIG. 6 so as to stop the operation of the outgoing mode.

If any key corresponding to the outgoing mode or searching mode is not inputted, the master 2 may read information of a general slave other than the registered slave.

Next, the searching mode routine will now be described in detail with reference to FIG. 7. The searching mode is a mode significantly used when a user returns to the user's house or office and then searches for an item.

After the control unit 10 of the master 2 enters into the searching mode based on the inputted key corresponding to the searching mode, the user may set a desired recognition distance and recognition width using keys for setting the recognition distance and recognition width, provided to the input unit 12. If the user does not set the recognition distance and recognition width, a recognizing operation for the registered slave 4*k* is performed using preset default values of the recognition distance and recognition width.

More specifically, if the user inputs a key for setting the recognition distance, the control unit 10 recognizes the inputted key at step 400 of FIG. 7 and then proceeds to step 402 of FIG. 7 so as to set a recognition distance desired by the user through the user interface unit and to store the recognition distance in the memory 18. If it is determined at the step 400 of FIG. 7 that the user does not input the key for setting the recognition distance, the control unit 10 proceeds to step 404 of FIG. 7 so as to set the recognition distance as a default value of the recognition distance.

If the user inputs a key for setting the recognition width, the control unit 10 recognizes the inputted key at step 406 of FIG. 7 and then proceeds to step 408 of FIG. 7 so as to set a recognition width desired by the user through the user interface unit and to store the recognition width in the memory 18. If the user does not input the key for setting the recognition width at the step 406 of FIG. 7, the control unit 10 sets the recognition width as a default value of the recognition width.

In the setting of the recognition width, if only one antenna ANT is installed in the master as shown in FIG. 2A or 3A, the default value of the recognition width is set, and a separate key for setting the recognition width is not provided.

If the user desires to find where a user's own item is placed at time such as time to work in the morning after the user sets the range (generally a few meters) of the recognition area suitable for the user, the user inputs a key for operating the searching mode. Accordingly, the control unit 10 of the master 12 recognizes the inputted key at step 412 of FIG. 7 and then proceeds to step 414 of FIG. 7 so as to communicate with the registered slave 4*k* in the range of the recognition area having the recognition distance and recognition width.

Then, the control unit 10 of the master 2 determines the presence or existence of a registered slave 4*k* communicated by the control unit 10. If the registered slave 4*k* communicated with the control unit 10 exits, the control unit 10 of the master 2 proceeds to step 418 of FIG. 7 so as to output a detection volume generated by the level of a recognized electric field intensity and to guide the user of the item information of the registered slave 4*k* using voice through the alarm and voice output unit 16. If it is determined at the step 416 of FIG. 7 that the registered slave 4*k* communicated with the control unit 10 does not exist, the control unit 10 of the master 2 proceeds to step 420 of FIG. 7 so as to perform a control of increasing the values for setting the recognition distance and recognition width. Then, the control unit 10 of the master 2 returns to the step 416 of FIG. 7 so as to determine the presence of existence of a registered slave 4*k* communicated by the control unit 10.

If the user moves close to the registered slave 4*k* or moves further from the registered slave 4*k*, the level of the recognized electric field intensity is changed. The control unit 10 of the master 2 recognizes the change in level at step 422 of FIG. 7 and then proceeds to step 424 of FIG. 7 so as to outputs a detection volume generated by the change in the level of the recognized electric field intensity and to guide user of the item information.

If the user moves distant from the item desired to find, the level of the recognized electric field intensity and the corresponding detection volume are weak. If the user moves close to the item desired to find, the level of the recognized electric field intensity and the corresponding detection volume are strong. Thus, the user can move to a place at which the detection volume is increased and find the item desired by the user.

If the user does not require the operation of the searching mode and inputs a key for stopping the searching mode through the input unit 12, the control unit 10 recognizes the inputted key at step 426 of FIG. 7 and then proceeds to step 428 of FIG. 7 so as to stop the operation of the searching mode.

If any key corresponding to the outgoing mode or searching mode is not inputted, the master 2 may read information of a general slave other than the registered slave.

In the disclosure, an item matched to a slave has been described as an example. However, it will be understood that the slave may be applied to animals including human beings because the slave has various forms.

According to the disclosure, if the distance between a user and an item is out of a predetermined range in an outgoing mode, a warning is provided to the user, so that it is possible to prevent, in advance, the user from losing the item and allow the user to quickly search for the item misplaced by the user in a searching mode.

While the disclosed embodiments have been described with respect to the specific embodiments, it will be apparent to those skilled in the art that various changes and modifications may be made without departing from the spirit and scope of the invention as defined in the following claims.

What is claimed is:

1. An apparatus for preventing loss of an item and quickly searching for the item, the apparatus comprising:

a slave configured to perform a function of a radio frequency identification (RFID) tag having unique identifier information in an internal tag memory; and a hand-held master configured to perform a function of an RFID reader and change a recognition distance at which the master recognizes the slave, wherein the master comprises:

a user interface unit configured to have an input unit and an output unit;

an antenna configured to communicate, by radio, with the slave;

a transmission/reception unit connected to the antenna so as to transmit/receive, by radio, data to/from the slave;

an alarm and voice output unit configured to output an alarm or voice;

an output power adjustment unit configured to adjust an output power of the transmission unit in the transmission/reception unit under a predetermined control; and a control unit configured to register a slave to be registered as a tag for preventing loss of an item and quickly searching for the item in a memory through the user interface unit, when there is a request for setting a range of a recognition area having the recognition distance of the registered slave through the user interface unit, set the requested range of the recognition area in the memory, when an outgoing mode is operated through the user interface unit, continuously perform, by radio, recognition communication between the master and the registered slave in the range of the recognition area through the output power adjustment unit, when the distance between the master and the registered slave is out of the range of the recognition area, provide an alarm and voice through the alarm and voice output unit of the master, and when a searching mode is operated through the user interface unit, output a detection volume generated by the level of a recognized electric field intensity of the registered slave and provide a voice through the alarm and voice output unit by trying recognition communication between the master and the registered slave in the set range of the recognition area.

2. An apparatus for preventing loss of an item and quickly searching for the item, the apparatus comprising:

a slave configured to perform a function of a radio frequency identification (RFID) tag having unique identifier information in an internal tag memory; and a hand-held master configured to perform a function of an RFID reader and change at least one of a recognition distance and a recognition width, at which the master recognizes the slave, wherein the master comprises:

a user interface unit configured to have an input unit and an output unit;

a plurality of antennas configured to communicate, by radio, with the slave;

a transmission/reception unit configured to transmit/receive, by radio, data to/from the slave;

a signal distribution and synthesis unit configured to selectively connect a signal between the transmission/reception unit and the plurality of antennas under a predetermined control;

an alarm and voice output unit configured to output an alarm or voice;

an output power adjustment unit configured to adjust an output power of the transmission unit in the transmission/reception unit under a predetermined control; and a control unit configured to register a slave to be registered as a tag for preventing loss of an item and quickly searching for the item in a memory through the user interface unit, when there is a request for setting a range of a recognition area having at least one of the recognition distance and recognition width of the registered slave through the user interface unit, set the requested range of the recognition area in the memory, when an outgoing mode is operated through the user interface unit, continuously perform, by radio, recognition communication between the master and the registered slave in the range of the recognition area through the selective use of the antennas and the output power adjustment unit, when the distance between the master and the slave to be registered is out of the range of the recognition area, provide an alarm and voice through the alarm and voice output unit of the master, and when a searching mode is operated through the user interface unit, output a detection volume generated by the level of a recognized electric field intensity of the registered slave and provide a voice through the alarm and voice output unit by trying recognition communication between the master and the registered slave in the set range of the recognition area.

3. The apparatus of claim 1, wherein the master further comprises a voice recognition and synthesis unit configured to perform voice recognition and voice synthesis.

4. The apparatus of claim 1, wherein the slave is configured to as a re-writable tag in which data is recorded on and erased from the memory.

5. The apparatus of claim 1, wherein the slave comprises tags formed in the shapes of a coin, a band, a stick, a card and a mobile phone strap in which an antenna is woven with a conductive fiber.

6. The apparatus of claim 2, wherein the master further comprises a voice recognition and synthesis unit configured to perform voice recognition and voice synthesis.

7. The apparatus of claim 2, wherein the slave is configured to as a re-writable tag in which data is recorded on and erased from the memory.

8. The apparatus of claim 2, wherein the slave comprises tags formed in the shapes of a coin, a band, a stick, a card and a mobile phone strap in which an antenna is woven with a conductive fiber.

9. A method for preventing loss of an item and quickly searching for the item in an apparatus comprising a slave configured to perform a function of a radio frequency identification (RFID) tag having unique identifier information in an internal tag memory and a hand-held master configured to perform a function of an RFID reader and change at least one of a recognition distance and a recognition width, at which the master recognizes the slave, the method comprising:

registering a slave to be registered as a tag for preventing loss of an item and quickly searching for the item by performing a registration mode through a user interface in the master;

when there is a request for setting a range of a recognition area having at least one of the recognition distance and the recognition width of the registered slave through the user interface of the master, setting the requested range of the recognition area in a memory;

when an outgoing mode is operated through the user interface of the master, setting a range of a recognition area through the selective use of a plurality of antennas and the adjustment of the transmission output power of the master and continuously performing, by radio, recognition communication between the master and the registered slave in the range of the recognition area;

when the distance between the master and the registered slave is out of the range of the recognition area while continuously performing the recognition communication between the master and the registered slave in the operation of the outgoing mode, providing an alarm and voice through the master;

when a searching mode is operated through the user interface of the master, trying the recognition communication between the master and the registered slave in the set range of the recognition area; and outputting a detection volume generated by the level of a recognized electric field intensity of the registered slave and providing a voice through the master by trying the recognition communication between the master and the registered slave in the operation of the searching mode.

10. The method of claim 9, further comprising: when item information is inputted to the master through an input interface having at least one of a voice recognition input and a touch screen input, in the registration mode, recording, by radio, the item information in a tag memory of a slave to be registered.

* * * * *